US009667003B2

(12) United States Patent
Huynh

(10) Patent No.: US 9,667,003 B2
(45) Date of Patent: May 30, 2017

(54) ELECTRICAL CONNECTOR

(71) Applicant: Nhan Huynh, Plano, TX (US)

(72) Inventor: Nhan Huynh, Plano, TX (US)

( * ) Notice: Subject to any disclaimer, the term of this patent is extended or adjusted under 35 U.S.C. 154(b) by 0 days.

(21) Appl. No.: 15/086,298

(22) Filed: Mar. 31, 2016

(65) Prior Publication Data

US 2016/0294131 A1 Oct. 6, 2016

Related U.S. Application Data

(60) Provisional application No. 62/142,140, filed on Apr. 2, 2015, provisional application No. 62/150,072, filed on Apr. 20, 2015.

(51) Int. Cl.

| | |
|---|---|
| ***H01R 24/62*** | (2011.01) |
| ***H01R 13/64*** | (2006.01) |
| ***H01R 24/64*** | (2011.01) |
| ***H01R 43/20*** | (2006.01) |
| *H01R 107/00* | (2006.01) |

(52) U.S. Cl.

CPC ..... *H01R 24/64* (2013.01); *H01R 43/20* (2013.01); *H01R 2107/00* (2013.01)

(58) Field of Classification Search

CPC .... H01R 23/02; H01R 13/631; H01R 13/629; H01R 23/025; H01R 23/005; H01R 24/62; H01R 24/64; H01R 24/60; H01R 13/64

USPC ..... 439/676, 660, 418, 374

See application file for complete search history.

(56) References Cited

U.S. PATENT DOCUMENTS

| | | | | | |
|---|---|---|---|---|---|
| 4,368,942 | A * | 1/1983 | Mathe | H01R 13/64 | 439/676 |
| 4,679,879 | A * | 7/1987 | Triner | H01R 12/79 | 439/425 |
| 5,312,273 | A * | 5/1994 | Andre | H01R 13/65802 | 439/188 |
| 2001/0027049 | A1* | 10/2001 | Kato | H01R 13/743 | 439/374 |
| 2002/0160663 | A1* | 10/2002 | Gutierrez | H01R 13/717 | 439/676 |
| 2005/0282442 | A1* | 12/2005 | Hyland | H01R 31/005 | 439/676 |
| 2010/0317216 | A1* | 12/2010 | Pocrass | H01R 24/60 | 439/345 |
| 2013/0171885 | A1* | 7/2013 | Zhang | H01R 13/6471 | 439/676 |
| 2014/0329416 | A1* | 11/2014 | Golko | H01R 29/00 | 439/676 |
| 2015/0288104 | A1* | 10/2015 | Regnier | H01R 24/62 | 439/676 |

* cited by examiner

*Primary Examiner* — Gary Paumen

(74) *Attorney, Agent, or Firm* — Bell Nunnally & Martin LLP; Craig J. Cox

(57) ABSTRACT

The present disclosure includes teachings for a jack and receptacle, and methods regarding same, that provide increased data capability and backwards compatibility with previous systems, such as RJ45. The present disclosure can be used for hardwire connections between electrical and computing components. Cable such as Cat 5 and Cat 6 can be used with the disclosed jack and receptacle.

14 Claims, 8 Drawing Sheets

610 provide a front face comprising four edges, a first plurality of connector pins on a first front edge, and a second plurality of connector pins on a second front edge opposing the first front edge

↓

600 620 provide a back face distal to and connected to the front face, and comprising a plurality of receptacles configured to receive a plurality of cables

Fig 19

ELECTRICAL CONNECTOR

CROSS REFERENCE TO RELATED INFORMATION

This application claims the benefit of U.S. Provisional Patent Application No. 62/142,140, filed Apr. 2, 2015, and U.S. Provisional Patent Application No. 62/150,072, filed Apr. 20, 2015, both titled "Electrical Connector", the contents of which are hereby incorporated herein in its entirety.

TECHNICAL FIELD

The present disclosure is directed to hardwire connections for electrical components, and in particular to a double pin set up jack and receptacle.

BACKGROUND OF THE INVENTION

RJ45 plugs are popular in the telecommunications industry. RJ45 plugs are used to connect PC computers, telephones, servers, credit card registers and a host of other devices. RJ45 is a type of 8P8C modular connector that was defined by TIA/EIA-568 from the Telecommunications Industry Association and the Electronic Industries Alliance.

RJ45 plugs comprise 8 physical pins. An RJ45 plug and an RJ45 receptacle can connect and provide connectivity from a device to a network, or between devices, or another setup. The devices/networks connected must be able to read and understand communication sent over a cable connecting them. The translation of communication can be governed by the pin/pair assignments given by T568A and T568B from TIA/EIA-568. Other devices may use a different standard. The cables used with RJ45 are typically eight conductor 100-ohm balanced twisted-pair cabling, including, for example, Category 5 cable. Previously, Cat 3 cable was popular, but nowadays Cat 5 or Cat 6 cable is used in many applications.

One disadvantage of RJ45 plugs is the 8 pin limit. This numerical limit places a cap on how fast data can be sent and translated through an RJ45 system.

BRIEF SUMMARY OF THE INVENTION

An embodiment of the teachings described herein can comprise a jack for hardwire connections between electrical components, comprising: a front face comprising four edges, a first plurality of connector pins on a first front edge, and a second plurality of connector pins on a second front edge opposing the first front edge; and a back face distal to the front face and comprising a plurality of receptacles configured to receive a plurality of cables.

Another embodiment comprises a receptacle for hardwire connections on an electrical component, comprising: an opening configured to receive a jack therein; and a connection face disposed at an interior end of the opening, comprising four edges, a first edge comprising a first plurality of connector pin receivers, and a second edge opposite the first edge and comprising a second plurality of connector pin receivers.

Another embodiment comprises a method of constructing a jack for hardwire connections between electrical components, comprising: providing a front face comprising four edges, a first plurality of connector pins on a first front edge, and a second plurality of connector pins on a second front edge opposing the first front edge; and providing a back face distal to, and connected to, the front face and comprising a plurality of receptacles configured to receive a plurality of cables.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 19 is a flow chart diagram of a method embodiment under the present disclosure.

DETAILED DESCRIPTION OF THE INVENTION

An embodiment of the teachings disclosed herein is a double pin connector comprising an RJ45 compatible head with 16 pins so as to double the bandwidth of the connection. An embodiment may go by the trade name double pin. A double pin receptacle can receive either a double pin plug/connector or an RJ45 plug/connector. A benefit of the teachings herein is that double pin connector sets provide increased speed and bandwidth. In addition, double pin connector sets are backwards compatible, thus enabling RJ45 and other eight pin-based devices to be enabled within a double pin based system.

Figure 1:
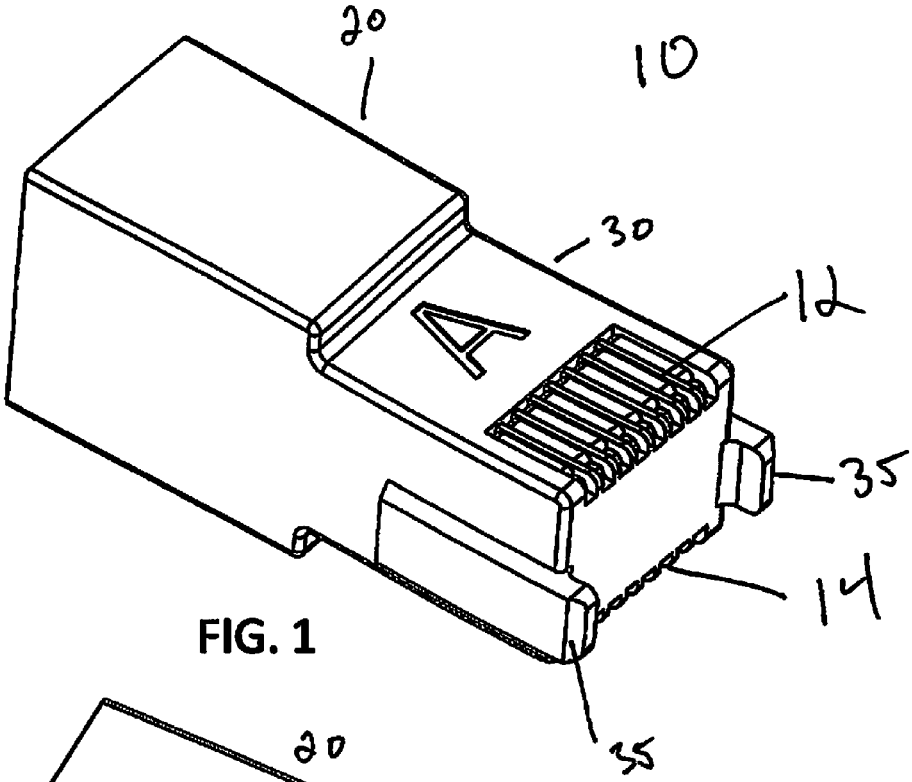
FIG. 1 is a diagram of an embodiment of a double pin plug.
Figure 2:
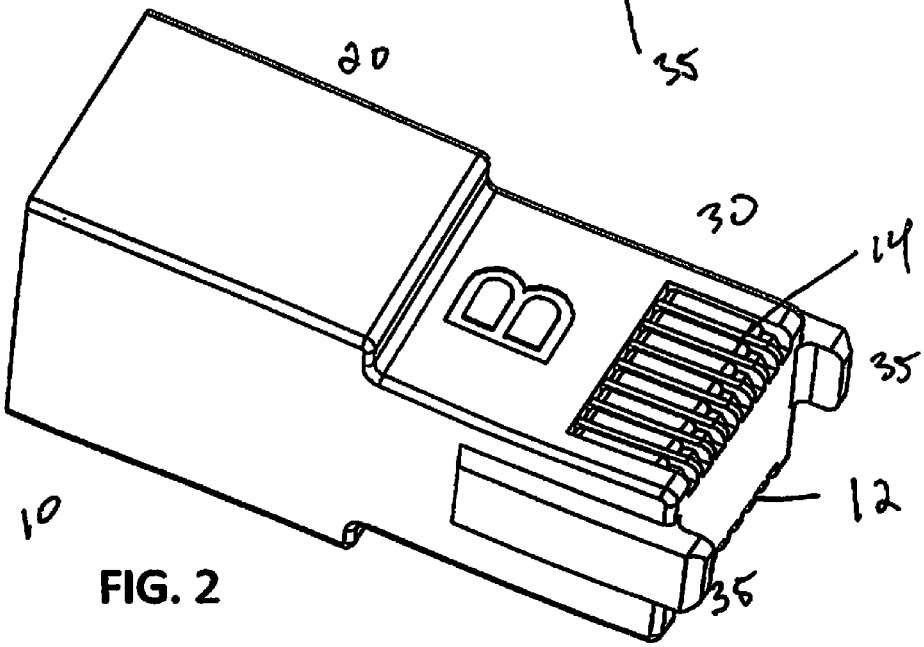
FIG. 2 is a diagram of the bottom of an embodiment of a double pin plug.
Figure 3:
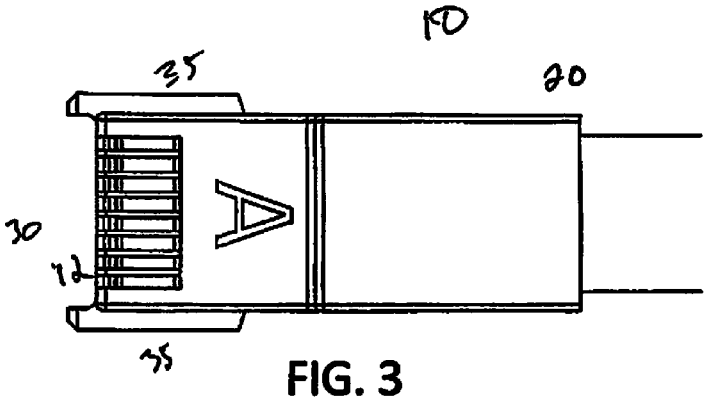
FIG. 3 is a diagram of a top down view of an embodiment of a double pin plug.
Figure 5:
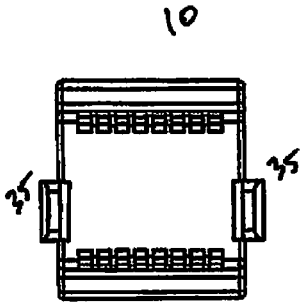
FIG. 5 is a diagram of a front view of an embodiment of a double pin plug.
Figure 4:
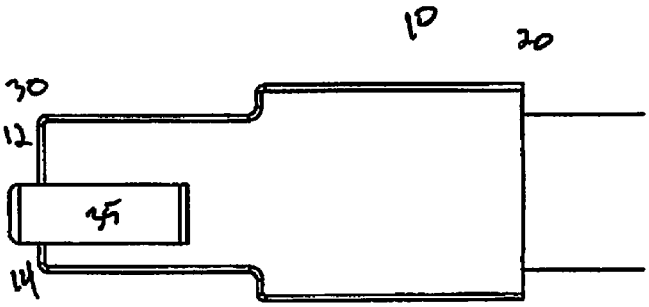
FIG. 4 is a diagram of a side view of an embodiment of a double pin plug.
Figure 6:
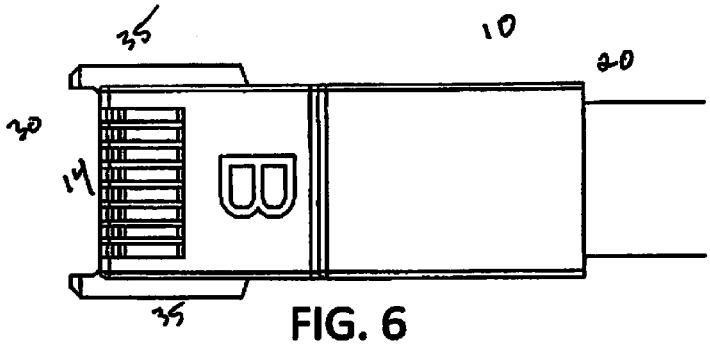
FIG. 6 is a diagram of a bottom view of an embodiment of a double pin plug.

FIG. 1 displays an embodiment of the teachings disclosed herein. Double pin plug 10 comprises a rear portion 20 and a front portion 30. Front portion 30 comprises a first pin set 12, a second pin set 14, and wings 35. FIG. 2 shows a bottom view of the same plug as FIG. 1.

Figure 7:
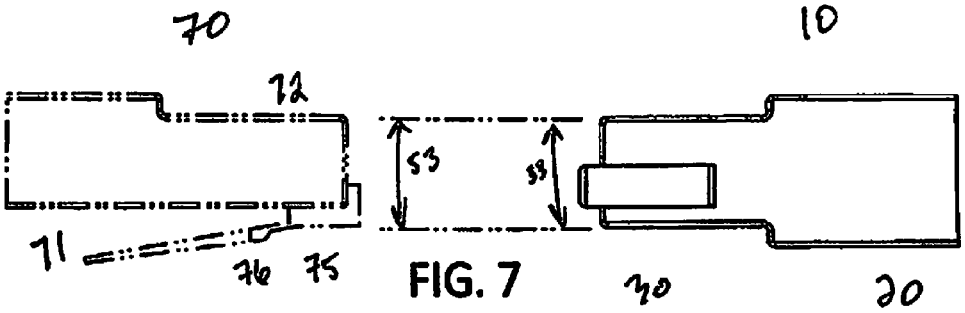
FIG. 7 is a diagram of an RJ45 plug and an embodiment of a double pin plug.

FIGS. 3-6 shows top, bottom, side and front views of an embodiment of the double pin plug. FIG. 7 shows a comparison of an embodiment of the double pin connector to a typical prior art RJ45 connector. The height 33 of front portion 30 of double pin connector 10 is the same as height 53 of front portion 72 with connector box 75 of RJ45 connector 70. Locking pin 76 helps to lock connector 70 into a receptacle.

Figure 8:
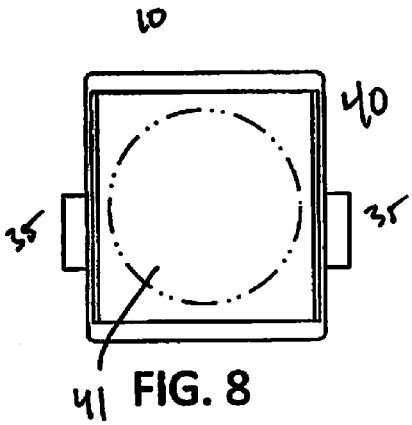
FIG. 8 is a diagram of the back side of an embodiment of a double pin plug.
Figure 9:
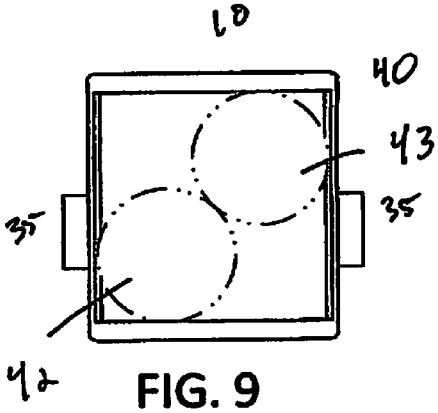
FIG. 9 is a diagram of the back side of an embodiment of a double pin plug.

FIGS. 8 and 9 show the back side 40 of embodiments of double pin connector 10. In FIG. 8 the connector 10 connects to a single cable 41. In FIG. 9 connector 10 connects to dual cables 42, 43, possibly similar to the harness shown in FIG. 16.

Figure 10:
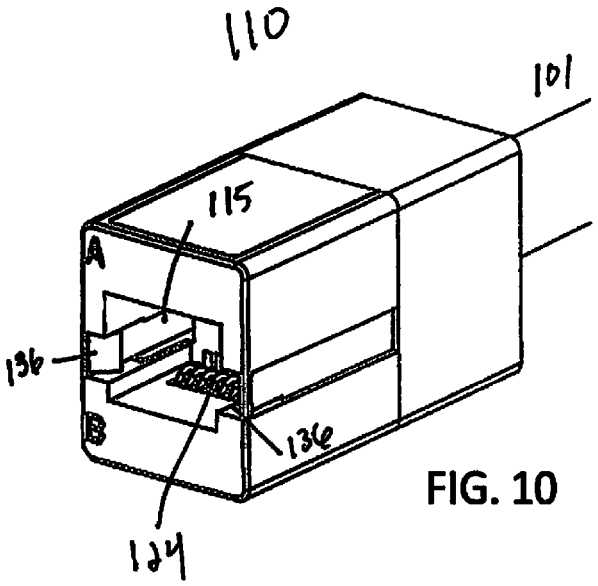
FIG. 10 is a diagram of an embodiment of a double pin receptacle.
Figure 11:
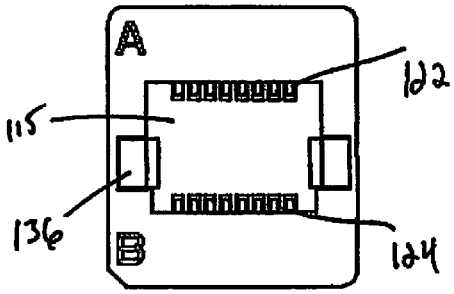
FIG. 11 is a diagram of a front view of a double pin receptacle embodiment.
Figure 12:
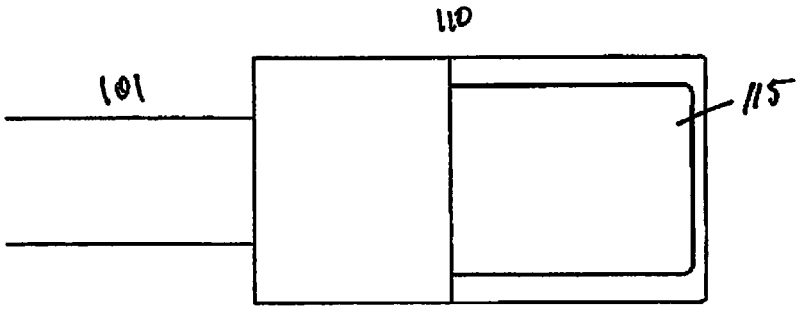
FIG. 12 is a diagram of a top down view of a double pin receptacle embodiment.
Figure 13:
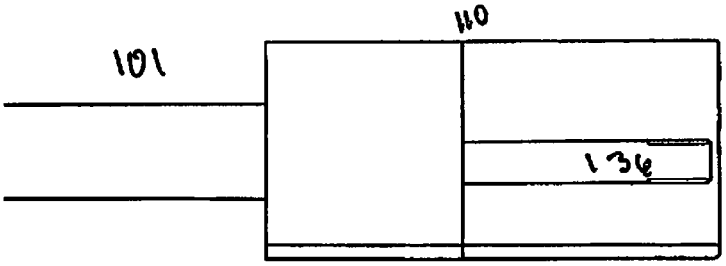
FIG. 13 is a diagram of a side view of a double pin receptacle embodiment.

FIG. 10 displays an embodiment of a double pin receptacle 110. The receptacle 110 of FIG. 10 can receive the plug embodiments in FIGS. 1-7. FIG. 11 shows the receptacle 110 of FIG. 10 from a front view. As shown, the first and second pin sets 12 and 14 of FIG. 1 can connect to first and second receiving pin sets 122 and 124. Carve out 115 receives the front portion 30 of plug 10 and grooves 136 receive wings 35 from a double pin plug. Receptacle 110 can connect to a cable 101. In other embodiments receptacle 110 can be integrated into a modem or other device. A prior art RJ45 receiver would only comprise one receiving pin set. An embodiment of a double pin receptacle such as shown in FIGS. 10 and 11 can receive either a RJ45 or a double pin plug. FIG. 12 shows a top down view of receptacle 110 with carve out 115 and cable 101. FIG. 13 displays a side view of receptacle 110 with grooves 136 and cable 101.

Figure 14:
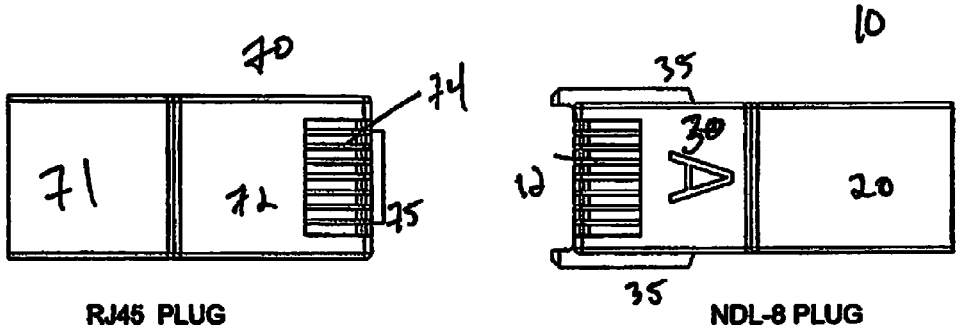
FIG. 14 is a diagram of a comparison of an RJ45 plug and a double pin plug embodiment.
Figure 15:
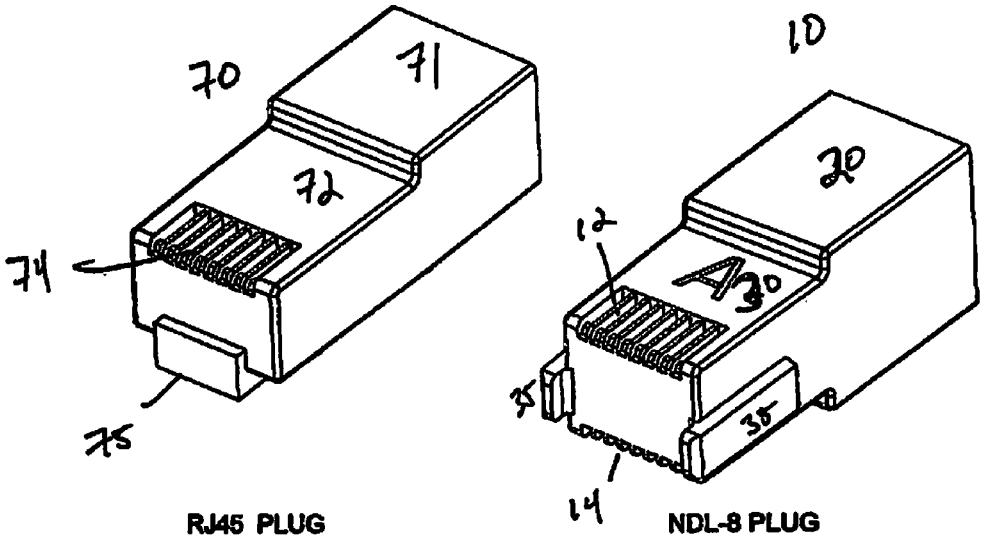
FIG. 15 is a diagram of a comparison of an RJ45 plug and a double pin plug embodiment.

FIG. 14 shows a top down comparison of an RJ45 plug 70 and a double pin plug 10. RJ45 plug 70 comprises a front portion 72 and a back portion 71. Pins 74 are located on the front portion 72, as well as connector box 75. FIG. 15 shows an isometric view of plug 70 and plug 10.

Figure 16:
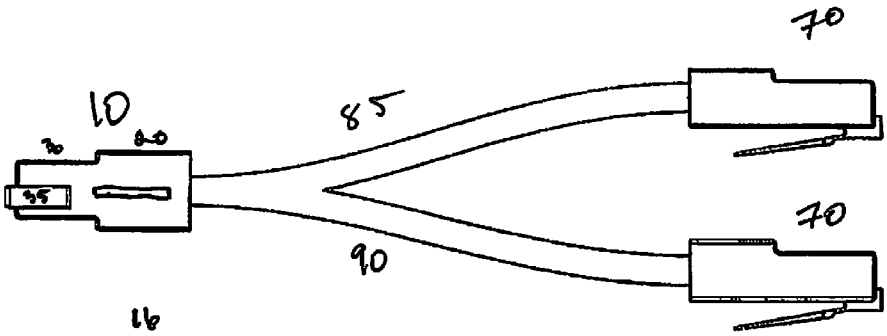
FIG. 16 is a diagram of a harness embodiment comprising a double pin plug.

FIG. 16 shows a split RJ45 and double pin harness 90. In this embodiment a single double pin plug 10 on one end is connected by a split cable 85 to two RJ45 plugs 70. A harness such as this can connect a double pin based device to several RJ45 devices. Because of double pin's double pin configurations, the single double pin plug 10 of FIG. 16 can match the data flow of two RJ45 inputs.

Figure 17:
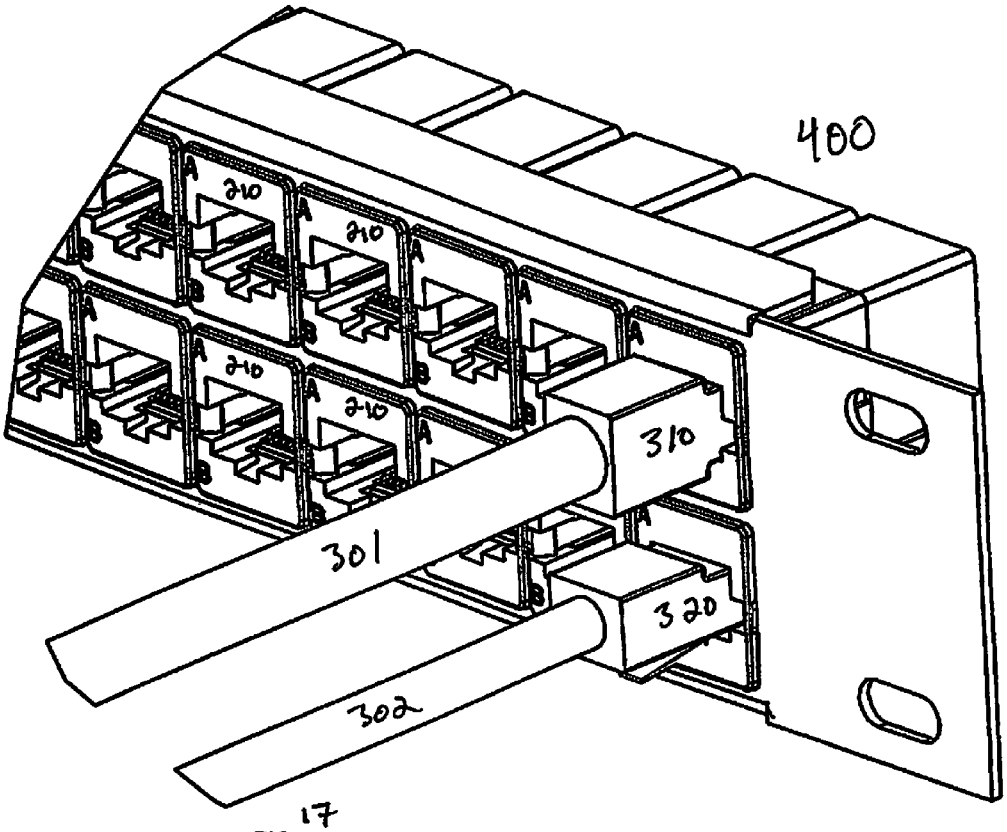
FIG. 17 is a diagram of a series of RJ45 and double pin receptacle embodiments.

FIG. 17 shows an embodiment of a modem 400 comprising double pin receptacles 210 that accept double pin plugs and RJ45 plugs. Double pin plug 310 connects to receptacle 210 and comprises a cable 301. RJ45 plug 320 can also attach to receptacle 210 and comprises cable 302. Modem 400 could be integrated into a rack mounted server or a variety of other devices.

Figure 18:
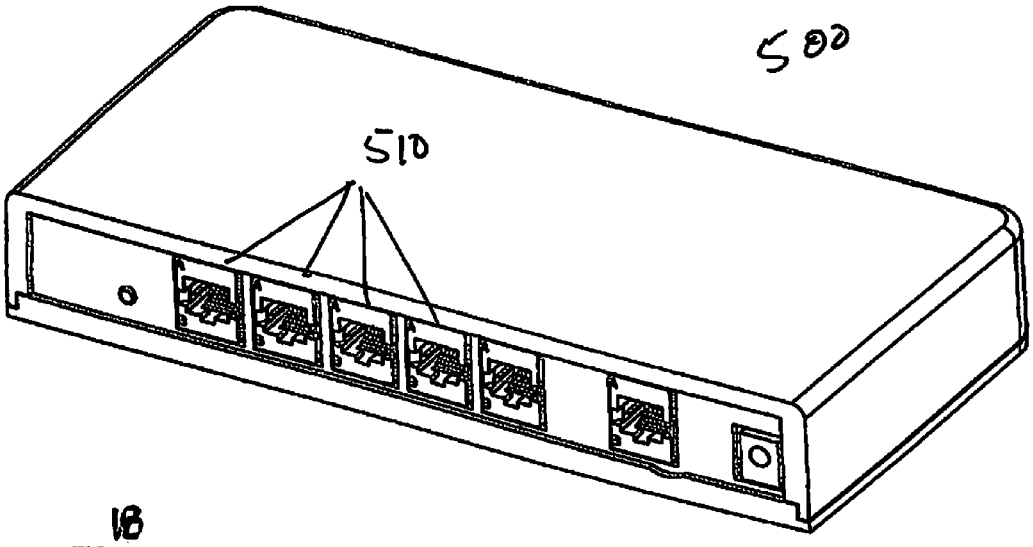
FIG. 18 is a diagram of a modem embodiment comprising double pin receptacles.

FIG. 18 shows another embodiment of a modem integrating double pin compliant receptacles 510.

FIG. 19 shows an embodiment of a method 600 for providing a data connection between two devices. At 610 a front race is provided comprising four edges, a first plurality of connector pins on a first front edge, and a second plurality of connector pins on a second front edge opposing the first front edge. At 620 a back face is provided that is distal to, and connected to, the front face and comprising a plurality of receptacles configured to receive a plurality of cables.

The pins, for example pins 12 and 14 of FIGS. 1-6, are conductive (sometimes made of copper) and can be set to communicate by a given protocol that is standardized. For example, the T568A or T568B pin/pair assignments can be used as defined in TIA/EIA-568. However, double pin connector sets can be used with a variety of pin/pair assignments or coding protocols.

Double pin plug of the connector set can be used to provide connections for: between rack mount modules in a data center; entertainment modules; built-in entertainment systems for new houses or for re-wires of existing houses; or various data connections for business situations in commercial, manufacturing, or retail.

A double pin receptacle or double pin connector set can be installed in place of RJ45 receptacles in any type of communication or electronic equipment and still be backwards compatible to RJ45 plugs. Samples of electrical components that can utilize a double pin embodiment as opposed to RJ45, while still providing backwards compatibility, include: PC computer, laptop, internet modem, WIFI module, network switch box, network hard drive, network cloud drive, rack mount data center modules, data center switch box, rack mount entertainment systems, television set, audio receiver, DVD player, cable box set, media box, retail credit card register, retail cash register, security & surveillance equipment, restaurant guest wireless device, and more.

The dimensions of a double pin jack or receptacle under the present disclosure are similar to those for RJ45 jacks and receptacles. Having the same dimensions helps ensure interoperability. However the present teachings can be applied across a variety of dimensions and sizes.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A jack for hardwire connections between electrical components, comprising:

a plug connector having a front portion and a rear portion, wherein the front portion includes a first plurality of connector pins on a first front edge, and a second plurality of connector pins on a second front edge opposing the first front edge, and wherein the front portion includes a wing on each of a first side edge and a second side edge, where the wings are closer to the second front edge than the first front edge; and wherein the rear portion of the plug connector includes at least one receptacle configured to receive one or more cables.

2. The jack of claim 1, wherein the first and second plurality of connector pins each comprise eight pins.

3. The jack of claim 1, wherein the jack is compatible with RJ45 receptacles.

4. The jack of claim 1, wherein the back face is configured to receive two cables.

5. The jack of claim 1, wherein the front face is smaller along at least one axis than the back face.

6. The jack of claim 1, wherein the back face is connected to Cat 5 or Cat 6 cable.

7. The jack of claim 1, wherein the back face is connected to cable configured to carry communication governed by the pin/pair assignments given by T568A and T568B.

8. A jack and receptacle combination for hardwire connections on an electrical component, comprising:

a jack component, the jack component comprising:

a plug connector having a front portion and a rear portion, wherein the front portion includes a first plurality of connector pins on a first front edge, and a second plurality of connector pins on a second front edge opposing the first front edge, and wherein the front portion includes a wing on each of a first side edge and a second side edge, where the wings are closer to the second front edge than the first front edge; and wherein the rear portion of the plug connector includes at least one receptacle configured to receive one or more cables; and a receptacle component comprising:

an opening configured to receive the jack component therein; and a connection face disposed at an interior end of the opening, comprising four receptacle edges, a first receptacle edge comprising a first plurality of connector pin receivers, and a second receptacle edge opposite the first edge and comprising a second plurality of connector pin receivers.

9. The jack and receptacle combination of claim 8, wherein the first and second plurality of connector receivers each comprise eight pins.

10. The jack and receptacle combination of claim 8, wherein the receptacle component is compatible with RJ45 jacks.

11. The jack and receptacle combination of claim 8, wherein the receptacle component is configured to receive two cables.

12. The jack and receptacle combination of claim 8, wherein the front face of the jack component is smaller along at least one axis than the back face.

13. The jack and receptacle combination of claim 8, wherein the back face of the jack component is connected to Cat 5 or Cat 6 cable.

14. The jack and receptacle combination of claim 8, wherein the back face of the jack component is connected to cable configured to carry communication governed by the pin/pair assignments given T568A and T568B.

* * * * *